United States Patent [19]

Allen

[11] Patent Number: 4,845,785

[45] Date of Patent: Jul. 11, 1989

[54] HINGED SHOULDER PAD

[76] Inventor: Fredric Allen, c/o BRB Industries, Inc., 467 Eleventh St., Hoboken, N.Y. 07030

[21] Appl. No.: 183,062

[22] Filed: Apr. 19, 1988

[51] Int. Cl.[4] ..... A41D 27/26

[52] U.S. Cl. ..... 2/268; 2/243 B

[58] Field of Search ..... 2/24, 268

[56] References Cited

U.S. PATENT DOCUMENTS

| | | | |
|---|---|---|---|
| 2,359,475 | 10/1944 | Gauthier . | |
| 2,442,008 | 5/1948 | Kagan et al. . | |
| 2,461,881 | 2/1949 | Diamond . | |
| 2,476,796 | 7/1949 | Bernstein . | |
| 2,478,340 | 8/1949 | Talalay | 2/268 |
| 2,624,885 | 1/1953 | MacManus | 2/268 |
| 2,627,368 | 2/1953 | Jantzen | 2/268 |
| 2,635,251 | 4/1953 | Silvestri | 2/268 |
| 2,638,603 | 5/1953 | Riedler et al. | 2/268 |
| 2,646,573 | 7/1953 | Morgenstern | 2/268 |
| 2,676,328 | 4/1954 | Skirow et al. . | |
| 2,902,695 | 9/1959 | Werner . | |
| 3,939,023 | 2/1976 | Magidson et al. . | |
| 4,332,633 | 6/1982 | Yamauchi et al. . | |
| 4,342,610 | 8/1982 | Ray, Jr. . | |

*Primary Examiner*—Werner H. Schroeder
*Assistant Examiner*—Jeanette E. Chapman
*Attorney, Agent, or Firm*—Gloria K. Koenig

[57] ABSTRACT

A hinged shoulder pad and method of forming such a pad is disclosed comprising precutting the component pieces or panels which will comprise the shoulder pad into a single integral unit from a blank of suitable material, such as resinated polyester, with each of the panels being cut into the desired size and shape to form the shoulder pad. Adjacent panels are cut through along their common base end or fold line leaving uncut portions at the extremities thereof to form hinges between the adjoining pieces, such that there is a slit formed between the hinges at each end. This permits the unfolded pad panels to be picked up as a singular unit and interfolded in the desired manner such that a laminated pad comprising the panels is formed of the desired thickness depending upon the number of layers employed. The thickness of the laminated pad can be increased or decreased by adding or reducing the number of pieces employed. Upon folding the panels into the desired laminated arrangement, a single tack is applied substantially centrally of the pad to hold the panels in place for subsequent heat molding to form the pad. The heat molding is conventionally applied to the entire pad such that the layers are securely bonded into the desired shoulder pad.

10 Claims, 1 Drawing Sheet

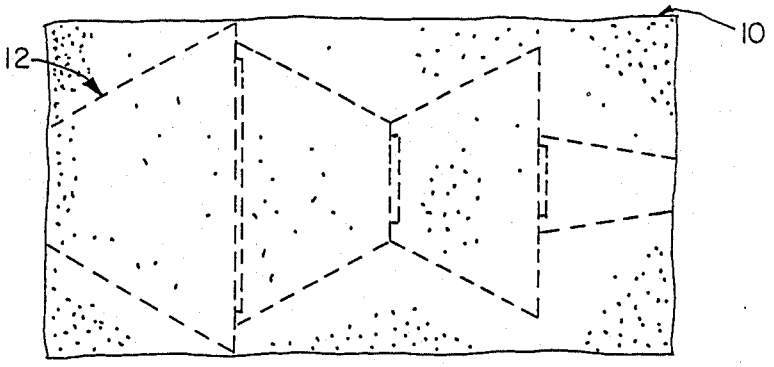
FIG. 1
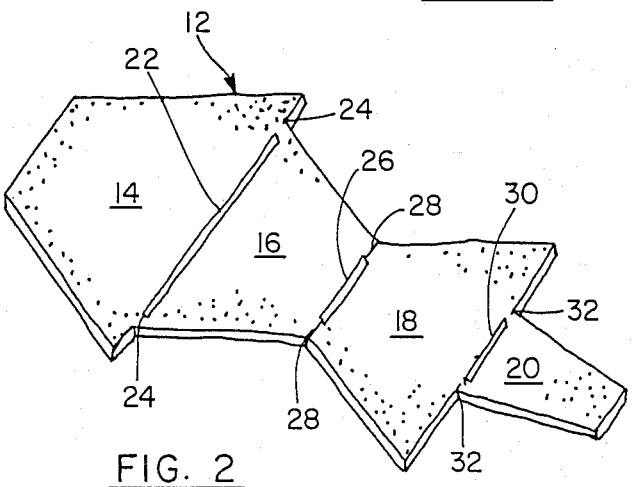
FIG. 2
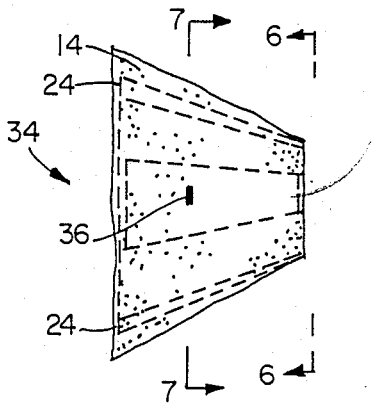
FIG. 5
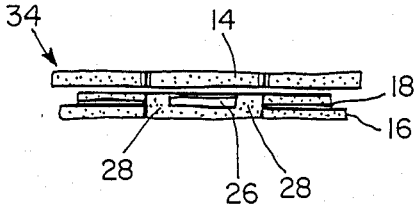
FIG. 6
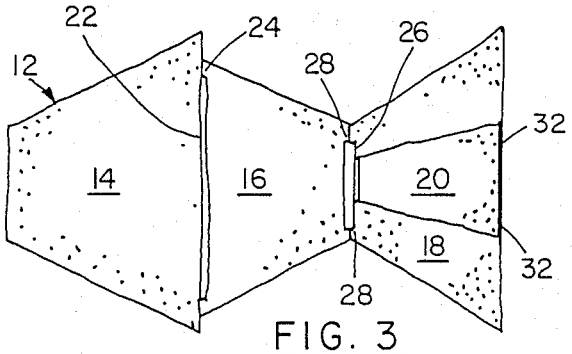
FIG. 3
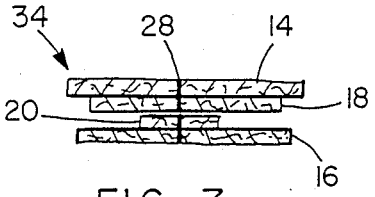
FIG. 7
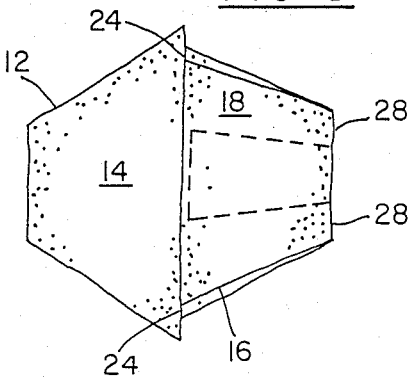
FIG. 4
FIG. 8
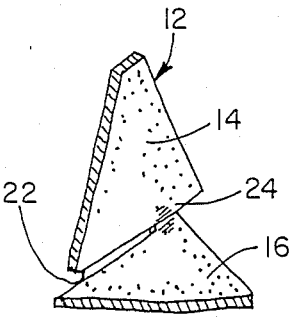

HINGED SHOULDER PAD

BACKGROUND OF THE INVENTION

1. Field of the Invention

The present invention relates to a shoulder pad which can be easily and efficiently formed in an economic fashion by a substantially automated process, comprising a plurality of interconnected hinged panels which form the integral pad, and which are readily formed into a laminate structure of desired thickness for subsequent use in a garment and the like.

2. Description of the Prior Art

While the prior art generally discloses the broad concept of partially cutting a workpiece and folding the workpiece on itself to obtain a multi-layered structure, it does not disclose the hinged shoulder pad and method of forming the same according to the present invention. Typical of such prior art is the Gauthier U.S. Pat. No. 2,359,475, wherein there is disclosed a method of making filter elements, with the filter comprising a plurality of hingedly connected circular members connected at a point on their circumference such that the members can be folded over onto the adjoining member. The problem exists, however, of potential misalignment of these members. Subsequent to the members being assembled, they are secured in place by means of an adhesive coating. Another prior are disclosure is that of the Magidson U.S. Pat. No. 3,939,023, which discloses a method of fabricating a brassiere pad that involves making a single cut in a rectangular fiberfull sheet. Thereafter, the parts of the sheet on either side of the cut are folded over, e.g. as shown in FIG. 3, to form a triangular piece and the overlapping areas are bonded over their entire surface. The thickness of the pad can be increased by the addition of separate individual fillers. The folded piece is then heat molded and the pieces are held together prior to such heat molding by means of a bonding agent. Still yet another prior art disclosure is that of Ray, Jr., U.S. Pat. No. 4,342,610, which discloses a method for intermittently slitting and folding fibrous insulation. According to this prior art method, a plurality of fibrous hinges are provided for connecting a plurality of fibrous batts, and an adhesive is used to laminate the batts to form a relatively thick insulation product. Other prior art disclosures which are illustrative of various methods of forming shoulder pads include the Skirow U.S. Pat. No. 2,676,328, wherein there is disclosed a series of discs between backing layers and which includes a stiffener. The formed mass is then cut in half and the entire assembly thereafter is compressed in a preheated molding die. The Werner U.S. Pat. No. 2,902,695, discloses a pad which is stitched while held in a curved position, and the Kagan U.S. Pat. No. 2,442,008, discloses a pad made from a single piece of material which is elliptical and is folded over upon itself to form a pad. The open edges are subsequently sewed together. The Diamond U.S. Pat No. 2,461,881, discloses another method of making a pad which includes a thermoplastic member between the folds of a bat. Yamauchi, U.S. Pat. No. 4,332,633, discloses a method of producing a shoulder pad blank wherein a piece of shoulder pad stock is sinusoidally cut into two intermediate blanks which fit into each other. The Bernstein U.S. Pat. No. 2,476,798, discloses a method of forming a shoulder pad which includes a fragrance of perfume.

All of the foregoing prior art disclosures and methods of forming shoulder pads suffer from various deficiencies which are not found in the present invention. For example, none of the prior art devices disclose the particular feature of combining a hinged shoulder pad according to the present invention which utilizes only a single tack point such as a stitch or a weld for holding the pad in place prior to the heat molding step. Nor is there disclosed a hinged shoulder pad comprising a plurality of pre-formed panels of integral varying desired sizes which are hingedly interconnected to form a unitary integral member, which panels are adapted for being interfolded in such a manner as to form a laminated shoulder pad which is readily adaptable for being heat molded throughout. Such a pad is molded throughout—not just at edges. Such a pad particularly lends itself to being formed in an automated process. Some of the particular advantages which are associated with the present invention are that the operator does not have to assemble each of the individual pieces which normally comprises the shoulder pads of the prior art. Instead, the operator is able to have the complete shoulder pad in front of her and merely is required to interfold the pieces in the desired arrangement preparatory to forming the shoulder pad in the heat mold. Alternatively, this could also be accomplished by means of an automated process with suitable machinery and equipment. Another advantage is that only a single tack is required prior to the step of heat molding of the pad. Finally, the fact that each of the panels comprising the pad are integrally connected together by the hinges will avoid the problem encountered by a pad comprised of separate pieces which is that they tend to separate during washing and/or dry cleaning of the garment in which the pad is located.

Typically, shoulder pads for use in garments such as ladies dresses, suits and the like have been made by precutting quadrangular pieces of material which are then manually stacked in a desired height by an operator. Thereafter, the stacked pieces are tacked in approximately four or five places at the corners and at the center to hold the pieces in position. This sandwich arrangement then is treated in a heat and pressure mold to form the shoulder pad. Various problems are associated with this prior art technique, not the least of which is that the operator must hand-position each of the component pieces which often are misaligned and require a plurality, i.e. at least four tacks which may be stitches or adhesive, in order to hold the pieces in position as the male shoulder mold is lowered onto the female shoulder mold in order to form the pad.

The shoulder pad and method of forming such a shoulder pad according to the present invention avoids the aforedescribed disadvantages.

SUMMARY OF THE INVENTION

The present invention essentially comprises a hinged integral shoulder pad and method of forming such a pad comprising precutting by means of a suitable cutting die the component pieces or panels which will comprise the shoulder pad into a singular integral unit from a thin substantially flat blank piece of suitable material, such as a resinated polyester with each of the panels being cut into the desired size and shape to form the shoulder pad. Adjacent panels are cut through along their common base end or fold line leaving an uncut portion at each of the extremities thereof to form hinges between the adjoining pieces, such that there is a slit formed between the hinges at each end. This permits the unfolded pad panels to be picked up as a singular unit and interfolded in the desired manner such that a laminated pad comprising the panels is formed having the desired thickness depending upon the number of layers or panels used. FIG. 8 shows an enlarged view of a typical hinge arrangement. The thickness of the laminated pad can be increased or decreased by adding or reducing the number of panels. Upon folding the panels into the desired laminate arrangement, a single tack comprising a heat weld or stitch is applied substantially centrally of the pad to hold the panels in place for subsequent heat molding to form the pad. The heat molding is applied to the entire pad such that the layers are securely bonded into the desired shoulder pad. In particular, it should pointed out that the thickness of the shoulder pad can be increased by adding additional panels or pieces. At the other extreme, the thickness can be reduced by omitting one or more of the panels. The panels also may comprise any configuration that will enable the resultant pad to have the desired shape for the garment in which it is to be fitted.

An object of the present invention is to provide a shoulder pad which can be assembled in a relatively easy and economical manner.

Another object of the invention is to provide a shoulder pad comprising a unitary integral form consisting of a plurality of hingedly connected panels adapted to be interfolded into the pad.

A further object of this invention is to provide an integral shoulder pad comprising a plurality of hingedly connected panels which is relatively easy to assemble and only requires limited securement prior to the molding process and a method of forming same.

These and other objects and advantages of the present invention will become apparent from the following description of the preferred embodiment of the present invention when considered in conjunction with the accompanying drawings.

BRIEF DESCRIPTION OF THE DRAWINGS

FIG. 1 is a plan view of the stock blank material from which the shoulder pad pattern is to be cut.

FIG. 2 is a perspective view of the shoulder pad pattern cut from stock blank material of FIG. 1 comprising a plurality of integrally connected hinged panels before being assembled into the shoulder pad according to the present invention.

FIG. 3 is a plan view of the shoulder pad pattern with only the tail panel folded over upon one of the intermediate panels.

FIG. 4 is a plan view showing the shoulder pad pattern with the tail and one of the intermediate panels folded upon the other of the intermediate panels.

FIG. 5 illustrates the shoulder pad pattern according to the present invention with all of the panels interfolded upon themselves to form a laminate structure with a single tack weld.

FIG. 6 is a cross-sectional view taken substantially along the line 6—6 in FIG. 5.

FIG. 7 is a cross-sectional view taken substantially along the line 7—7 in FIG. 5.

FIG. 8 is an enlarged partial perspective view showing a hinged interconnection of adjacent panels of the shoulder pad.

DESCRIPTION OF A PREFERRED EMBODIMENT

Referring now to the drawings wherein like parts are designated by the same reference numeral throughout the several views, there is illustrated in FIG. 1 a blank or piece of stock material 10 which typically may comprise bonded polyester fiber or similar material, having a pattern as generally shown by the dotted line 12 defined in the material. The material is a resinated polyester, i.e., a polyester material inpregnated with resin which will bond to adjacent layers upon the application of heat and pressure. The pattern corresponds to the desired number of panels and configuration and size to form a shoulder pad upon interfolding of each of the panels upon each other in a particular array. The pattern typically is cut from the material 10 by means of a suitable standard cutting die which precuts the component pieces, which in a preferred embodiment of this invention comprises four panels. These include the end panel 14, the central or intermediate 16, 18 panels which are of a medium size relative to the end panel and the tail piece or panel 20 which is the smallest of the panels shown. Each panel has a quadrangular shape. The intermediate panels are of slightly different shape in the preferred embodiment, although they can be of the same shape and size if desired for a particular pad. The cutting die also partially cuts through the common base ends of the adjoining panels 14, 16 to define a slit or elongated opening 22 and uncut portions at each extreme end of the slit 22 which form the hinge portions 24. A similar opening (shorter in length) 26 is formed between medium size or intermediate panels 16 and 18 with hinge portions 28 defined at opposite ends of the opening. Between the intermediate panel 18 and the tail panel 20 is an opening 30 with hinges 32 located at the extremities thereof. When the shoulder pattern is cut from the material 10, it would appear in a plan view substantially as shown in FIG. 2, permitting the entire pattern in shoulder pad to be picked up as a single integral unit.

In order to form a shoulder pad having a predetermined thickness which would correspond to essentially four panels, the end piece or tail 20 is folded over onto the middle or intermediate panel 18 as best illustrated in FIG. 3. The layered panel arrangement comprising the tail piece 20 and the intermediate panel 18 is thereafter folded upon the other intermediate panel 16 to form the arrangement as shown in FIG. 4. The final step in the folding process is to fold the layered arrangement comprising the two intermediate panels 16, 18 having the tail panel 20 disposed or interfolded between them in juxtaposition relative to the end or largest panel 14 such that an overall shoulder configuration as shown in FIG. 5 is formed with panel 14 disposed adjacent the panel 18. The shoulder pad thus comprises a laminate structure generally illustrated as 34.

In this array, it is desirable to hold all of the layered panels in place for the subsequent step of heat molding. To accomplish this end, a central tack in the form of a single sewn stitch or heat weld 36 is formed substantially centrally of the overall laminate structure 34. If the pieces are tacked together by a heat weld, then an adhesive is applied in the area of the tack and is activated by heat applied during the molding step. Subsequent to tacking all of the layers together, the entire laminated structure is subjected to a heat molding. This step essentially is a standard method well known in the industry. Basically, the assembled pad is placed in a female mold and the male mold is lowered onto the pad. Both molds are heated conventionally, and the application of heat and pressure reforms the pad into the desired shape.

It is apparent that the thickness of the overall shoulder pad can be increased by adding additional pieces or panels to the basic pattern. Thus, in the preferred embodiment the tail piece is located between the medium size panels in order to further increase the thickness of the pad as desired. Alternatively, the thickness can be reduced by either omitting the tail panel or omitting one of the medium sized panels alone or together with the tail panel. The thickness of laminated structure which comprises the shoulder pad according to the preferred embodiment is shown in cross-section in FIG. 6 and 7. As shown, the single tack 28 is all that is required to hold the laminated structure together for the heat molding step in contrast to multiple tack points required in prior art configurations.

It should be understood that, while there is disclosed a preferred embodiment of the present invention, the invention is subject to many variations, modifications and changes in detail. It is intended that all matter contained in the foregoing description and as shown in the accompanying drawings shall be interpreted as illustrative only and not in a limiting sense.

I claim:

1. A shoulder pad having a laminated unitary structural arrangement comprising a plurality of juxtaposed panels overlying one another, hinge means integrally connecting adjacent ones of said panels together for enabling relative flexible pivotal movement therebetween, a pair of hinge means located along the fold line of adjacent ones of said panels and spaced apart to define an opening between them, said hinge means causing the panels to be uniformly aligned in a predetermined position when interfolded.

2. A shoulder pad according to claim 1 including a single tack for securing said panels in position.

3. A shoulder pad according to claim 2 wherein said tack comprises adhesive.

4. A shoulder pad according to claim 1 wherein each of said panels comprises a quadrangular configuration.

5. A shoulder pad according to claim 1 wherein said laminated structure comprises four panels having an overall similar configuration including a large end panel hingedly connected with an intermediate size panel which is smaller than said end panel and is hingedly connected with a substantially similar intermediate panel which is hingedly connected with an end tail panel disposed between said intermediate panels of said laminated structure.

6. A shoulder pad according to claim 1 wherein said hinge means comprise the same material as said panels.

7. A shoulder pad according to claim 6 wherein said material comprises a resinated polyester.

8. A method of forming a shoulder pad comprising a plurality of integrally connected panels comprising the steps of (a) forming a pattern comprising a plurality of different size panels in a piece of stock material; (b) cutting said pattern from said stock material, including cutting slits in the common boundary between adjoining ones of said panels such that said panels remain integrally connected at opposite ends of said slit; (c) interfolding the hinged panels along said common boundary into a laminated structure which defines said shoulder pad.

9. A method according to claim 8, including the step of tacking said plurality of interfolded hinged panels at a single location for holding said panels together in a laminated structure.

10. A method according to claim 8, wherein said shoulder pad comprises a plurality of four hinged quadrangular shaped panels, including the step of folding said end tail panel into a position disposed between said intermediate panels.

* * * * *